United States Patent [19]

Jaquay

[11] 4,155,749

[45] May 22, 1979

[54] PROCESS FOR CONVERTING NON-FERROUS METAL SULFIDES

[75] Inventor: Louis H. Jaquay, Pittsburgh, Pa.

[73] Assignee: Dravo Corporation, Pittsburgh, Pa.

[21] Appl. No.: 911,066

[22] Filed: May 31, 1978

[51] Int. Cl.[2] ..... C22B 4/00

[52] U.S. Cl. ..... 75/23; 75/6; 75/7; 75/73; 75/75; 75/76; 75/77; 75/82; 423/47; 423/542; 423/571

[58] Field of Search ..... 75/6, 7, 23, 73, 75, 75/76, 77, 82; 423/47, 542, 571

[56] References Cited

U.S. PATENT DOCUMENTS

| | | | |
|---|---|---|---|
| 2,683,077 | 7/1954 | Lewis | 75/23 |
| 3,627,510 | 12/1971 | Uogt et al. | 75/76 |
| 3,792,998 | 2/1974 | Norro | 75/10 R |
| 3,941,587 | 3/1976 | Queneau et al. | 75/72 |
| 4,003,740 | 1/1977 | Huggins et al. | 75/7 |
| 4,010,030 | 3/1977 | French | 75/76 |
| 4,072,507 | 2/1978 | Rajcevic et al. | 75/7 |

OTHER PUBLICATIONS

Dravo Corp., Publication No. 74ENCO8, Article "TBRC A New Smelting Technique", R. A. Danide and L. H. Jaquay, Feb. 20, 1972.

Dravo Corp., Publication No. 74ENCO7, "Full Scale TBRC Smelting Tests on Copper Concentrate", R. A. Danide and L. H. Jaquay, Feb. 24, 1974.

*Primary Examiner*—L. Dewayne Rutledge
*Assistant Examiner*—John P. Sheehan
*Attorney, Agent, or Firm*—Parmelee, Miller, Welsh & Kratz

[57] ABSTRACT

Non-ferrous metal sulfides are converted to recover metals therefrom in a high speed rotary converter, wherein an oxygen-containing gas is used for said conversion, with sulfur trioxide added to the converter along with the oxygen-containing gas to assist in control of temperatures of the charge during conversion, the sulfur trioxide being reduced to sulfur dioxide within the converter and exhausted therefrom.

8 Claims, 1 Drawing Figure

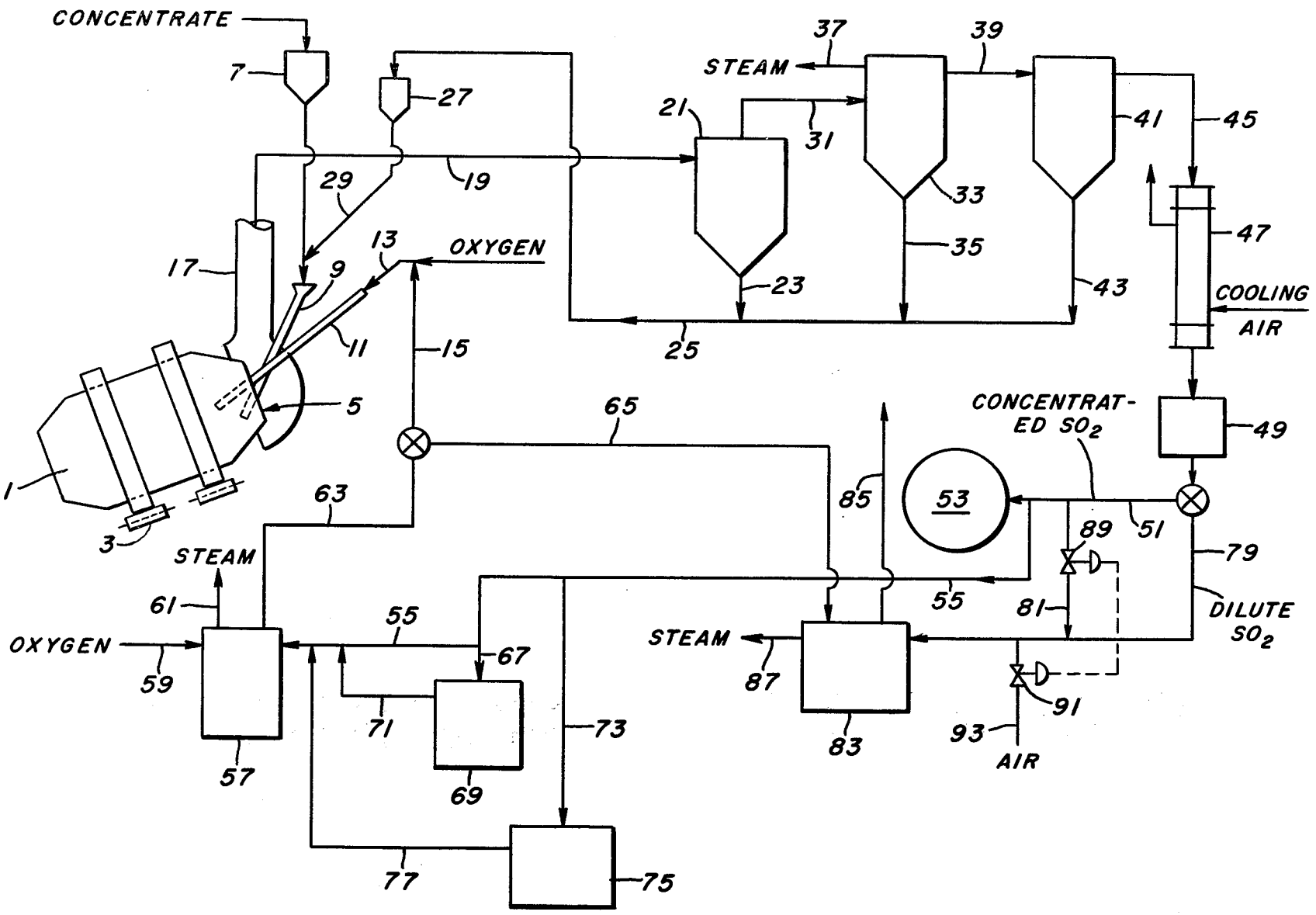
COOLING AIR
DILUTE $SO_2$
CONCENTRATED $SO_2$
AIR
STEAM
OXYGEN
CONCENTRATE
STEAM
OXYGEN
1
3
5
7
9
11
13
15
17
19
21
23
25
27
29
31
33
35
37
39
41
43
45
47
49
51
53
55
57
59
61
63
65
67
69
71
73
75
77
79
81
83
85
87
89
91
93

PROCESS FOR CONVERTING NON-FERROUS METAL SULFIDES

BACKGROUND OF THE INVENTION

The use of a top blown rotary converter for the conversion of sulfide concentrates to recover non-ferrous metals such as copper, nickel, lead, cobalt and the like has become a significant means for such conversion. In use of such converters, sometimes known as Kaldo converters, the sulfides are smelted and the non-ferrous metals reduced using oxygen or oxygen-containing gases to convert sulfides to $SO_2$ with surface blowing by means of a lance.

The use of a top blown rotary converter in conversion of sulfide concentrates has been described in the article "TBRC A New Smelting Technique" by R. A. Daniele and the present inventor, presented at the 1972 AIME Annual Meeting, San Francisco, Calif. Feb. 20–24, 1972, and in the article "Full Scale TBRC Smelting Tests on Copper Concentrate" by said authors, presented at the 1974 AIME Annual Meeting, Dallas, Tex. Feb. 24–28, 1974, the contents of said articles being incorporated by reference herein.

When pure oxygen is used to produce, for example, blister copper from copper concentrates, the oxidation of the iron and sulfur present in the concentrates produces more heat than is consumed in the process. This excess heat must be either absorbed or removed in some manner so as to prevent excess temperatures from developing in the converter.

Methods have been proposed for removal of excess heat developed during conversion of concentrates in a top blown rotary converter such as (1) the dilution of the oxygen by use of air-oxygen mixtures with the nitrogen content of the air absorbing excess heat, (2) the injection of liquid water directly into the converter, or (3) the charging of copper scrap which is melted with the excess heat. This latter method is well suited to absorption of the heat but, unfortunately, sufficient scrap is rarely available at the converter site. The other two methods described, while absorbing the heat, have the disadvantage of excessive dilution and contamination of the exhaust gases discharged from the converter. If sulfuric acid is to be made, the water vapor must be removed and, if sulfur dioxide is to be recovered, or elemental sulfur is to be produced, from the exhaust gases, considerable more energy will be required because of the dilution of the exhaust gases. While dilution of the oxygen with sulfur dioxide would result in reduction of the impurities in the exhaust gas, this requires a high recycle volume.

In the present invention, sulfur trioxide is used as a diluent for the oxygen-containing gas charged to the converter, with the advantages of reducing the dilution of sulfur dioxide in the exhaust gas, providing a source of oxygen by the decomposition of sulfur trioxide to sulfur dioxide in the converter under operating conditions, and providing a high heat absorbing capacity that is approximately four and one-half to five times that of an equal volume of nitrogen and two and one-half to three times that of sulfur dioxide with resultant lower recycle volume, as well as subsequent recovery of heat from the system, through subsequent catalytic oxidation of sulfur dioxide to sulfur trioxide, for production of high pressure steam.

BRIEF SUMMARY OF THE INVENTION

An improved method for producing non-ferrous metals from a sulfide concentrate in a high speed rotary converter where oxygen-containing gas is blown into the converter so as to convert the sulfide concentrates to metal and exhaust sulfur dioxide from the converter, wherein sulfur trioxide is blown into the converter along with the oxygen-containing gas, with sulfur trioxide being reduced to sulfur dioxide in the converter and exhausted along with sulfur dioxide produced during the conversion of the concentrates. The sulfur trioxide addition assists in control of the temperature within the charge in the converter without introducing impurities into the exhaust gases from the converter.

BRIEF DESCRIPTION OF THE DRAWING

The drawing schematically illustrates an apparatus usable in carrying out the present process and provides a flow diagram of the process.

DETAILED DESCRIPTION

In the drawing, a top blown high speed rotary converter 1 is illustrated for use in conversion of a sulfide concentrate to recover non-ferrous metals such as copper, nickel, lead, cobalt or the like, from the sulfide concentrates. The rotary converter 1, as is conventional, is rotated by supporting rollers 3 and has an open mouth 5. Sulfide concentrates are charged to the converter 1 by means of a concentrate hopper 7 through a chute or other charging means 9 through the open mouth 5. During the conversion of the sulfide concentrates to recover the value metal therefrom, an oxygen-containing gas, which may comprise oxygen, air, or diluted streams thereof, is blown through the mouth of the converter 1 through a lance 11, the oxygen-containing gas being fed to the lance through line 13 from a source (not shown). A line 15 for feeding sulfur trioxide into the oxygen-containing gas for dilution thereof connects with line 13.

During the conversion of the non-ferrous metal sulfide concentrates to metal, with the formation and exhaustion of sulfur dioxide gas, the conversion is normally effected at atmospheric pressure and, depending upon the particular metal being recovered at an elevated temperature of between about 1000°–1650° C. Generally, as is known, lead concentrates are converted at temperatures in the range of 1000°–1250° C., while copper concentrates are converted at temperatures in the range of 1150°–1350° C., and nickel and cobalt concentrates are converted in the higher area of the above range, between about 1300°–1650° C. The conversion is effected by oxidizing the concentrates, with sulfur dioxide formed and exhausted from the converter, and conventional sampling or analyzing techniques used to determine completion of the conversion to the extent desired. During such conversion, temperature control is needed and excess heat must be removed from the charge in order to maintain the desired temperature range.

At these temperatures, and in the presence of the non-ferrous concentrates in the charge, the sulfur trioxide is reduced to sulfur dioxide and the sulfur dioxide thus produced exhausted from the converter along with sulfur dioxide formed by the oxygen-containing gas contact and conversion of the non-ferrous concentrates. This formation of sulfur dioxide from the sulfur trioxide charged to the converter absorbs heat and by control of the same, the temperature of the charge can be maintained within the desired range during conversion without feeding impurities into the exhaust gas system. In addition, the sulfur trioxide during reduction provides oxygen for use in the conversion of the concentrates, lessening the amount of oxygen that need be supplied through the lance.

A hood 17 is provided adjacent the mouth 5 of the rotary converter so that exhaust gases from the converter are contained, these exhaust gases being carried by line 19 to a dust separator 21, such as a cyclone separator. In the separator 21, dust and other fine solid particles in the exhaust gas are separated from the exhaust gas stream and returned by means of line 23 to line 25 from which the dust is passed to a dust collector 27 and from there is returned to the converter for recovery of metal values therefrom by line 29 which leads to the charging means 9.

The hot exhaust gases are discharged from the separator 21 through line 31 and charged to a waste heat boiler 33 in which heat is removed from the hot gases. Solids separating in the waste heat boiler are turned by line 35 to line 25 for recycle to the converter, while steam, produced by the hot gases in the boiler, is removed through line 37 for use where desired. From the waste heat boiler, the partially cooled exhaust gases are passed by line 39 to a final precipitator 41 to remove any residual dust particles, with the separated residual dust particles discharged through line 43 to line 25 for reuse, while the dust free, partially cooled exhaust gases flow through line 45 to an air cooled cooling chamber 47 and then to a drying tower 49, for the removal of water therefrom. The dry, cooled exhaust gas contains primarily sulfur dioxide. The sulfur dioxide may be separated into two streams, with a concentrated stream of sulfur dioxide carried through line 51 to a storage tank 53. From the concentrated $SO_2$ storage tank 53, sulfur dioxide is withdrawn through line 55 and charged to a catalytic oxidation unit 57 of known construction. Oxygen is charged to the catalytic oxidation unit 57 through line 59 and the sulfur dioxide is catalytically oxidized to sulfur trioxide, with steam or other by-products discharged through line 61. The sulfur trioxide produced in the catalytic oxidation unit 57 is discharged therefrom through line 63 and is fed to line 15 for use in the conversion process as hereinbefore described. A portion of the sulfur trioxide may also be diverted from line 63 to line 65 for use in a sulfuric acid plant as discussed hereinafter.

A stream of concentrated sulfur dioxide may also be diverted from line 55, by means of line 67, to a conventional liquid sulfur dioxide plant 69, to produce a liquid sulfur dioxide product, with exhaust gases therefrom returned, through line 71, to line 55 for use in the catalytic oxidation unit 57. Or, if desired, a stream of concentrated sulfur dioxide may be diverted from line 55, through line 73 to a conventional elemental sulfur plant 75, wherein the sulfur dioxide is converted to elemental sulfur as a product. Exhaust gases from the elemental sulfur plant may also be returned by way of line 77 to line 55 for use in the catalytic oxidation unit 57.

Returning now to the gaseous flow from the drying tower 49, a second stream of sulfur dioxide therefrom, a dilute sulfur dioxide stream may be charged to line 79, with line 81 preferably also charging concentrated sulfur dioxide into line 79, for admixture therewith. This sulfur dioxide mixture is charged to a sulfuric acid plant 83 to produce a sulfuric acid product, with exhaust gases therefrom discharged through line 85 to the atmosphere, while steam may be recovered for heating purposes through line 87. As illustrated, sulfur trioxide, if desired, may also be charged to the sulfuric acid plant by means of line 65.

The relative ratio of the charge of dilute sulfur dioxide from line 79 and concentrated sulfur dioxide from line 81 for use in the sulfuric acid plant 83 and the air content may be regulated by a valve 89 in line 81 and a valve 91 in line 93 which feeds air to the system. By conventional regulation of these valves, the sulfur dioxide balance, flow control and air flow to the sulfuric acid plant 83 can be monitored.

The system thus provides a process for removing excess heat from a conversion of non-ferrous sulfide concentrates in a rotary converter, while also providing for catalytic oxidation of sulfur dioxide exhaust gases therefrom to sulfur trioxide for use in the conversion. Also, alternatives are provided for use of the sulfur dioxide exhaust gas streams, if desired, in the production of liquid sulfur dioxide, elemental sulfur or sulfuric acid.

I claim:

1. In a method for producing non-ferrous metals from a non-ferrous metal sulfide concentrate charge in a high speed rotary converter wherein an oxygen-containing gas is blown into said converter to convert said concentrates to non-ferrous metal with a sulfur dioxide exhaust gas being discharged therefrom, the improvement wherein sulfur trioxide is blown into said converter along with said oxygen-containing gas to assist in the control of the temperature of said charge during said converting, with sulfur trioxide reduced to sulfur dioxide within the converter and exhausted therefrom.

2. The method for producing non-ferrous metals from a non-ferrous metal sulfide concentrate as defined in claim 1 wherein sulfur dioxide in said sulfur dioxide exhaust gas is converted to sulfur trioxide for introduction into said converter along with said oxygen-containing gas.

3. The method for producing non-ferrous metals from a non-ferrous metal sulfide concentrate as defined in claims 1 or 2 wherein said sulfur trioxide contains a minor amount of sulfur dioxide.

4. The method for producing non-ferrous metals from a non-ferrous metal sulfide concentrate as defined in claim 1 wherein said non-ferrous metal is selected from the group consisting of copper, nickel, lead, cobalt and mixtures thereof.

5. The method for producing non-ferrous metals from a non-ferrous metal sulfide concentrate as defined in claim 1 wherein at least a portion of the sulfur dioxide in said sulfur dioxide exhaust gas is catalytically oxidized to sulfur trioxide and said sulfur trioxide is introduced into said converter along with said oxygen-containing gas.

6. The method for producing non-ferrous metals from a non-ferrous metal sulfide concentrate as defined in claim 1 wherein at least a portion of the sulfur dioxide in said sulfur dioxide exhaust gas is converted to liquid sulfur dioxide.

7. The method for producing non-ferrous metals from a non-ferrous metal sulfide concentrate as defined in claim 1 wherein at least a portion of the sulfur dioxide in said exhaust gas is converted to elemental sulfur.

8. The method for producing non-ferrous metals from a non-ferrous metal sulfide concentrate as defined in claim 1 wherein at least a portion of the sulfur dioxide in said exhaust gas is converted to sulfuric acid.

* * * * *